US009199280B2

(12) United States Patent
Viny

(10) Patent No.: US 9,199,280 B2
(45) Date of Patent: Dec. 1, 2015

(54) APPARATUS AND METHOD FOR SEPARATING SOLID WASTE

(76) Inventor: Steven Viny, Chagrin Falls, OH (US)

( * ) Notice: Subject to any disclaimer, the term of this patent is extended or adjusted under 35 U.S.C. 154(b) by 0 days.

(21) Appl. No.: 14/125,773

(22) PCT Filed: Jun. 15, 2011

(86) PCT No.: PCT/US2011/040496

§ 371 (c)(1),
(2), (4) Date: Dec. 12, 2013

(87) PCT Pub. No.: WO2012/173615

PCT Pub. Date: Dec. 20, 2012

(65) Prior Publication Data

US 2014/0102955 A1 Apr. 17, 2014

(51) Int. Cl.
*B07B 4/04* (2006.01)
*B07B 13/00* (2006.01)

(52) U.S. Cl.
CPC *B07B 4/04* (2013.01); *B07B 13/003* (2013.01)

(58) Field of Classification Search
CPC ..... B07B 4/04; B07B 9/00; B07B 13/10; B07B 13/116; B07B 13/003; B07B 4/02; B07B 4/025
USPC ..... 209/639, 644, 691–693, 707, 932
See application file for complete search history.

(56) References Cited

U.S. PATENT DOCUMENTS 2,151,894 A * 3/1939 Cambessedes ..... 209/31
2,772,776 A * 12/1956 Myron ..... 209/45
4,072,273 A 2/1978 Reiniger
4,101,035 A * 7/1978 Burger ..... 209/693
4,141,450 A * 2/1979 Clin et al. ..... 209/3.1
4,174,030 A * 11/1979 Philibert ..... 198/494
5,101,977 A 4/1992 Roman
5,409,100 A * 4/1995 Brennan ..... 198/607
5,957,297 A * 9/1999 Eramaja ..... 209/20
6,024,226 A 2/2000 Olivier
6,446,813 B1 9/2002 White
7,237,680 B2 * 7/2007 Viny ..... 209/644
8,020,706 B2 * 9/2011 Hendrickson et al. ..... 209/707
8,307,987 B2 * 11/2012 Miller et al. ..... 209/139.1
2004/0226864 A1 11/2004 Tse
2006/0180522 A1 * 8/2006 Legtenberg ..... 209/639
2011/0297591 A1 * 12/2011 Schmidt et al. ..... 209/635

* cited by examiner

*Primary Examiner* — Joseph C Rodriguez
(74) *Attorney, Agent, or Firm* — Howard M. Cohn; Daniel Cohn

(57) ABSTRACT

A sorting system and method for separating solid waste including heavy fraction, mid fraction and light fraction materials. A first conveyor belt system for moves the solid waste from a first end to a second end so that the solid waste cascades over the second end whereby the heavy fraction material falls downward to a first collection area and the mid fraction and light fraction material are conveyed by a first planar sheet of air to a second conveyor belt system. The second conveyor belt system moves the mid fraction and light fraction material received from the first conveyor belt system from a third end to a fourth end of the second conveyor belt system whereby a rollable mid fraction of the solid waste can tumble backwards to drop into a second collection area while the remaining mid fraction and light fraction solid waste continues to the fourth second end and cascades over the fourth end whereby the mid fraction pieces of solid waste fall downward to a third collection area and light fraction solid waste is carried away by a second planar sheet of air.

21 Claims, 3 Drawing Sheets

APPARATUS AND METHOD FOR SEPARATING SOLID WASTE

TECHNICAL FIELD OF THE PREFERRED EMBODIMENT

The preferred embodiment relates to method and apparatus for separating materials such as for example single stream recyclables, mixed materials including but not limited to trash and solid waste. The stream of waste could be separated into a stream of heavy fraction material such as concrete, wood, rock, brick and ceramics, a mid-fraction material containing denser materials, such as polyvinyl chloride containing plastics, textiles, high density polyethene, thermoplastic polymer resins, and heavier paper material, and a light fraction material, such as paper and light plastic film.

BACKGROUND OF THE PREFERRED EMBODIMENT

Separating pieces of different types of garbage, or trash items from one another is important because certain components of solid waste have economic value when separated for recycling purposes while other components require special handling for reasons related to toxicity, fuel value and chemical reactivity. For example, ultralight materials, such as paper and light plastics, can be easily composted or used as a fuel. Also, certain items of trash can present hazards (e.g., toxicity, flammability), and must be handled appropriately. Many techniques are known for separating items having different sizes, weights, and consisting or various materials.

Applicant is not aware of any prior art reference which, in his judgment as one skilled in the art to which the present embodiment most nearly pertains, would anticipate or render obvious the present embodiment as set forth below.

BRIEF SUMMARY OF THE PREFERRED EMBODIMENT

According to an embodiment, a sorting system for separating materials such as for example single stream recyclables, mixed materials including but not limited to trash and solid waste. The stream of solid waste could be separated into heavy fraction, mid fraction and light fraction materials, comprises: a first conveyor belt system for moving the solid waste from a first end to a second end so that the solid waste cascades over the second end whereby the heavy fraction material falls downward to a first collection area and the mid fraction and light fraction material are conveyed by a first planar sheet of air to a second conveyor belt system; the second conveyor belt system for moving the mid fraction and light fraction material received from the first conveyor belt system from a third end to a fourth end of the second conveyor belt system whereby a rollable mid fraction of the solid waste can tumble backwards to drop into a second collection area while the remaining mid fraction and light fraction solid waste continues to the fourth second end and cascades over the fourth end whereby the mid fraction pieces of solid waste fall downward to a third collection area and light fraction solid waste is carried away by a second planar sheet of air.

According to an embodiment, a method for separating materials such as for example single stream recyclables, mixed materials including but not limited to trash and solid waste. The stream of waste could be separated into heavy fraction, mid fraction and light fraction materials, comprises the steps of: moving the solid waste from a first end to a second end of a first conveyor belt system so that the heavy fraction material falls to a first collection area and the mid fraction and light fraction material are conveyed to a second conveyor belt system; moving the mid fraction and light fraction material received from the first conveyor belt system from a third end to a fourth end of the second conveyor belt system whereby a rollable mid fraction of the solid waste can tumble backwards to drop into a second collection area while the remaining mid fraction and light fraction solid waste cascades over the fourth end whereby the mid fraction pieces of solid waste fall downward to a third collection area and light fraction solid waste is collected in a fifth collection area.

The present embodiment is a sorting system for separating materials such as for example single stream recyclables, mixed materials including but not limited to trash and solid waste according to density. The embodiment comprises a first conveyor belt system for moving pieces of solid waste from a first end to a second end disposed at a higher elevation than the first end so that the pieces of solid waste cascade over the second. The higher density pieces of solid waste fall more or less directly downward to a first collection area, while lower density pieces of solid waste are blown away from the second end by a planar sheet of air from an air knife disposed at the second end. A second conveyor belt system receives at its first end lighter weight pieces of solid waste from the first conveyor belt system and carries them from a first end of the second conveyor belt system to a second end of the second conveyor belt system disposed at a higher elevation than the first end. Higher density pieces of solid waste can tumble backwards to fall off of the first end and drop into the first collection area while the remaining pieces of solid waste continue to the second end and cascade over the second end whereby higher density pieces of the solid waste fall downward to a second collection area. Lower density pieces of solid waste get blown away from the second end by a planar sheet of air from an air knife disposed at the second end.

The idea is also a method for separating materials such as for example single stream recyclables, mixed materials including but not limited to trash and pieces of solid waste according to density. The method comprises the moving of pieces of solid waste from a first end of a first conveyor belt system to a second end of the first conveyor belt system at a higher elevation than the first end. The pieces of solid waste cascade over the second end. Higher density pieces of solid waste fall downward to a first collection area and lower density pieces of solid waste are blown onto a second conveyor belt system by a planar sheet of air. The method yet further comprises the moving the pieces of solid waste received at a first end of the second conveyor belt system to a second end of the second conveyor belt system disposed at a higher elevation than the first end. Higher density pieces of the received solid waste tumble backwards to fall off of the first end and drop into the first collection area while the remaining pieces of received solid waste continue to the second end and cascade over the second end whereby higher density pieces of the solid waste fall downward to a second collection area. The method finally involves blowing lower density pieces of solid waste away from the second end by a planar sheet of air to a third collection area.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Often, similar elements may be referred to by similar numbers in various figures (FIGs) of the drawing, in which case typically the last two significant digits may be the same, the most significant digit being the number of the drawing figure (FIG).

FIG. 1 is a schematic side view of the overall embodiment, in accordance with the present invention.

FIG. 2A is a schematic side view of an exemplary conveyor belt system with air manifold and air knife feature, in accordance with the present invention.

FIG. 2B is a schematic upper end-on view of an exemplary conveyor belt system, with air manifold and air knife feature, in accordance with the present invention.

FIG. 3A is a schematic side view of the first conveyor belt system including air manifold and air knife, in accordance with the present invention.

FIG. 3B is a schematic side view of the second conveyor belt system including air manifold and air knife, in accordance with the present invention.

DETAILED DESCRIPTION OF THE PREFERRED EMBODIMENT

Figure 1:
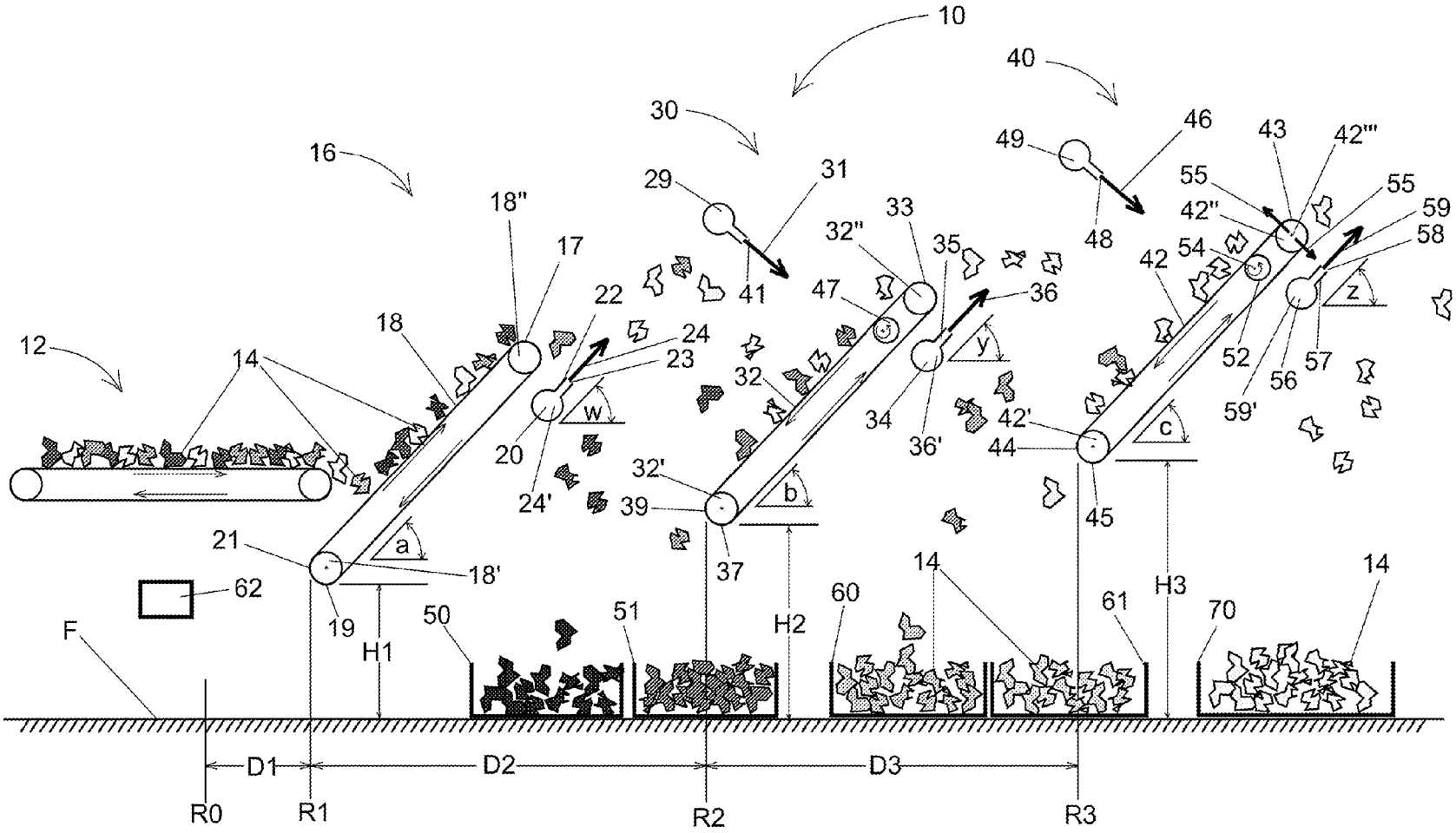

The present embodiment is envisioned by the inventor as an efficient way to separate trash into a heavy fraction material such as concrete, wood, rock, brick and ceramics, a mid-fraction material containing denser materials, such as polyvinyl chloride (PVC) containing plastics, textiles, high density polyethene (HDP), thermoplastic polymer resins, and heavier paper material, and a light fraction material, such as paper and light plastic film. One advantage of the present embodiment is to produce a stream of light fraction material including waste paper and plastics (less PVC) that are clean burning and having a high fuel value and which can be compressed into fuel bales. With respect to PVC, the embodiment described in detail below is to have a very low tolerance for rigid plastics that contain chlorine, because of the hydrogen chloride that can form during combustion and pyrolysis and the formation of aerosol particles of highly corrosive hydrochloric acid. It is envisioned that rigid PVC-containing plastics will, before the final or third conveyor belt system described below, be diverted out of the final stream light fraction clean-burning pieces of solid waste. Moreover, one or more mid fraction streams of waste material containing a high percentage of rigid plastics, which can be further processed and recycled, and therefore has value, will be collected. The present embodiment furthermore uses air jets, called herein "air knives", which provide an "air bridge" such that lightweight, light fraction materials are carried to separate collection areas and bins or to an additional conveyor system for collecting and processing the lightweight, light fraction materials while the heavy fraction materials and the mid fraction materials fall out into collection areas and bins designed to receive them.

Throughout the present specification and claims, the method and apparatus for separating materials 14 disclosed herein include materials such as for example single stream recyclables and mixed materials including but not limited to trash and solid waste. Therefore, each mention of solid waste or trash can mean single stream recyclables and other mixed materials.

In brief summary, the present embodiment is an apparatus and method for sorting and separating pieces of solid waste according to density. More specifically, the present embodiment incorporates a multiplicity of at least two and preferably three conveyor systems, each of which includes a conveyor belt that is oriented such that the solid waste begins at a first end and is carried to a second end that has a higher elevation than the first end whereby the heavier, higher density pieces of solid waste, which can be previously shredded, fall downward to a collection area while lower density pieces of solid waste get blown away from the second end by a planar sheet of air emitted from an air knife that provides a bridge of air which conveys or propels lighter weight waste stream fractions away from heavier fraction streams, separating them into one or more mid fraction streams such as ones that can be further processed and/or recycled. The flat or planar sheet of air, called herein an air bridge, typically produced by an air knife, helps to separate light-weight pieces of solid waste from heavier or denser pieces by conveying or propelling the lighter weight pieces of solid waste farther downstream from the second end of each conveyor belt. The three conveyor belt systems 10 operate serially, which means that the unsorted pieces of solid waste are conveyed along the first conveyor system 16, at the elevated end of which the heaviest pieces of solid waste fall into a first collection area 50 with the remaining pieces of solid waste continuing onward downstream to the second and third conveyor systems 30 and 40, respectively, which have provision for mid fraction solid waste to be collected before the lightest pieces of the third move to the farthest reach of the third conveyor system. The first collection area 50 can be constructed of two spaced walls of the same or different heights to control the amount of the selected waste product to collect.

Referring to FIG. 1, the solid waste separation system 10 is shown in schematic side view. A delivery system 12 (shown as a horizontally disposed conveyor belt, though it could as well be a chute or screw drive arrangement) carries pieces of solid waste 14 to a location above the first end 19 of a first conveyor belt system 16, consisting of a conveyor belt 18 supported by at least two rollers 18' and 18", one of which drives the conveyor belt in the direction indicated by the arrows toward a second end 18". The conveyor belt system 16 has an elevation angle "a" that is variable, suitably between approximately 30 degrees and 60 degrees from the horizontal, such as 45 degrees, and it has an elevated second end 17. The rollers 18' and 18" are horizontally disposed parallel to the floor F. The bottom most portion 19 of the roller 18' is situated some positive distance H1 above floor F.

Throughout this description, the term "conveyor belt system" refers most generally to the conveyor belt and to air blowing systems associated therewith. However, in some instances, the term "conveyor belt system" means the same as "conveyor system" or "conveyor belt."

The pieces 14 of solid waste include, by way of example, a heavy fraction material such as concrete, wood, rock, brick and ceramics, a mid-fraction material containing denser materials, such as polyvinyl chloride containing plastics, textiles, high density polyethene, thermoplastic polymer resins, and heavier paper material, and a light fraction material, such as paper and light plastic film. The solid waste material 14 can be initially processed by means such as shredding for size reduction, i.e., it can be shredded to a maximum size limit. While it might in some cases be desirable to initially shred the sold waste material, it is not necessary and in many cases, unshredded material, such as solid waste. Moreover, the system and method of operation of the present embodiments can be used to sort single stream recyclables, compost, or virtually any rigid and non-rigid material.

Figure 2B:
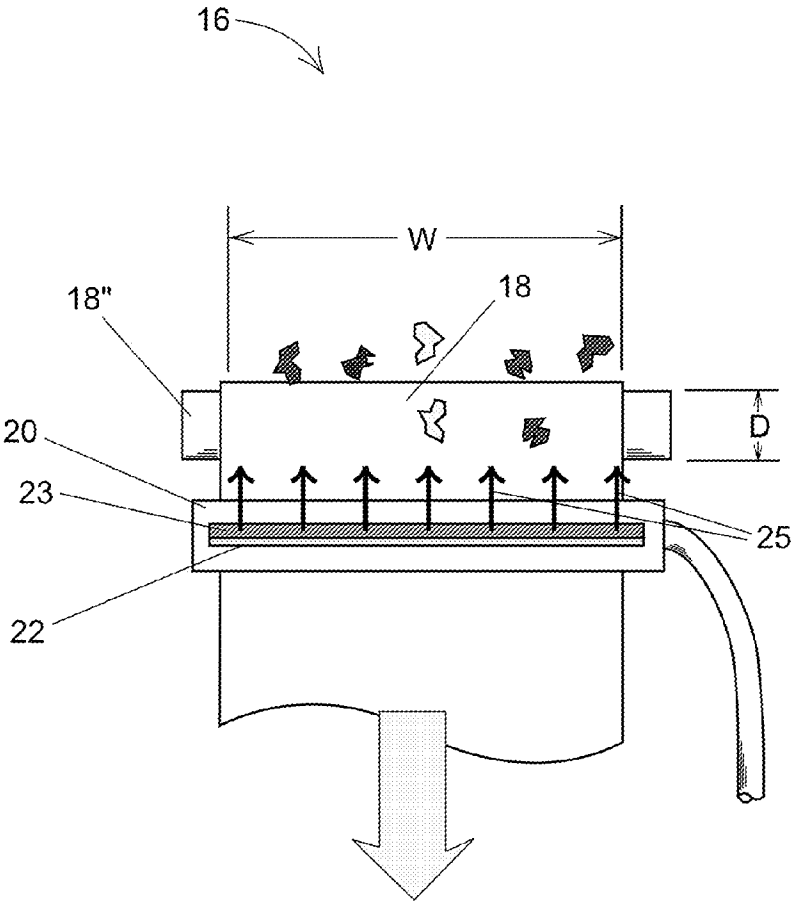
Figure 2A:
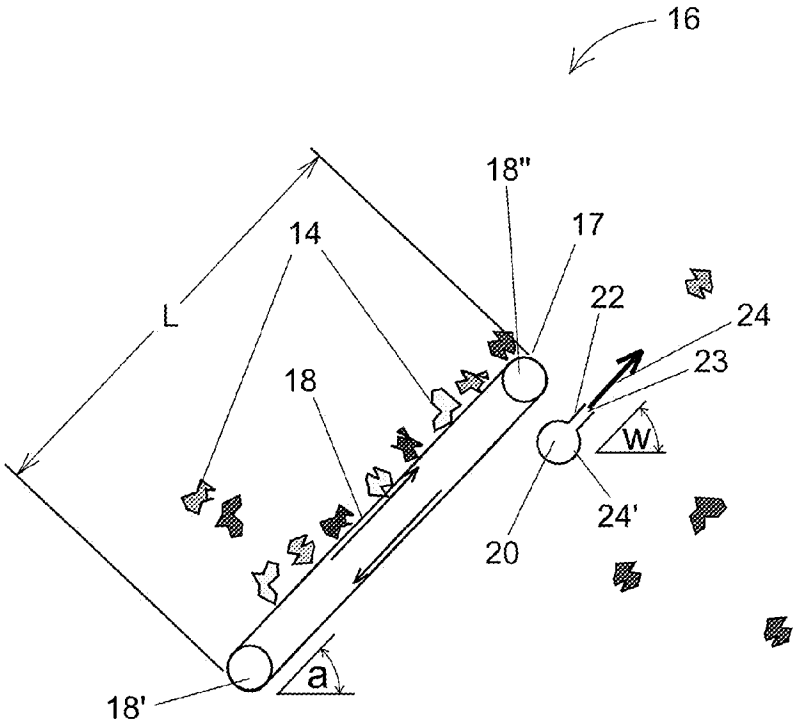

FIG. 2A shows the first conveyor system 16 in orthogonal lateral schematic view. Situated near and beneath the elevated second end 17 of the conveyor belt system 16 is an air manifold 20 having a first air knife system 24' including a planar air ejection nozzle 22 with an elongated orifice 23 through which a planar sheet of air, or air knife 24 (arrow), also considered an air bridge blows generally downstream in the same direction as the conveyor belt 18. The length L of the conveyor belt 18 (FIG. 2A) is envisioned to be on the order of between about 3 meters and 12 meters. The air knife 24 (in FIG. 2A) is indicated by the arrows 25 in the schematic end-on view of FIG. 2B. In operation, the function of the air knife 24 is to support the mid fraction and light fraction pieces of solid waste 14 downstream and farther from the conveyor, i.e., more toward the right in FIG. 1.

In the end-on schematic view of FIG. 2B, the conveyor belt 18 of the first conveyor system 16 is shown as envisioned as having a width W of at least, such as, for example, 50 centimeters. The belt 18 could be wider, as needed, for example, two meters or more. In this example, the rollers 18' and 18" preferably have diameter D on the order of 25 to 30 centimeters.

Referring to FIG. 2A, the air manifold 20 that is underneath and approximately at the end of the conveyor belt 18 of the first conveyor system 16, blows the planar sheet of air or air bridge that is the air knife 24 (arrow) generally in the downstream direction of travel of the conveyor belt (i.e., left-to-right, as viewed). The planar air knife 24 may be inclined at an angle "w" with respect to horizontal which may be the same as, greater than or less than the angle "a" of the conveyor system 16.

Figure 3B:
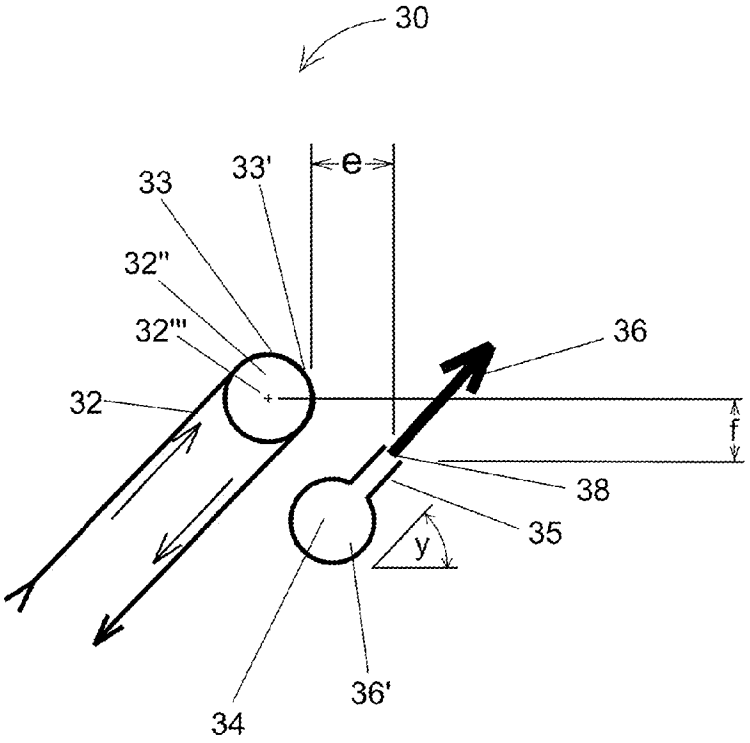
Figure 3A:
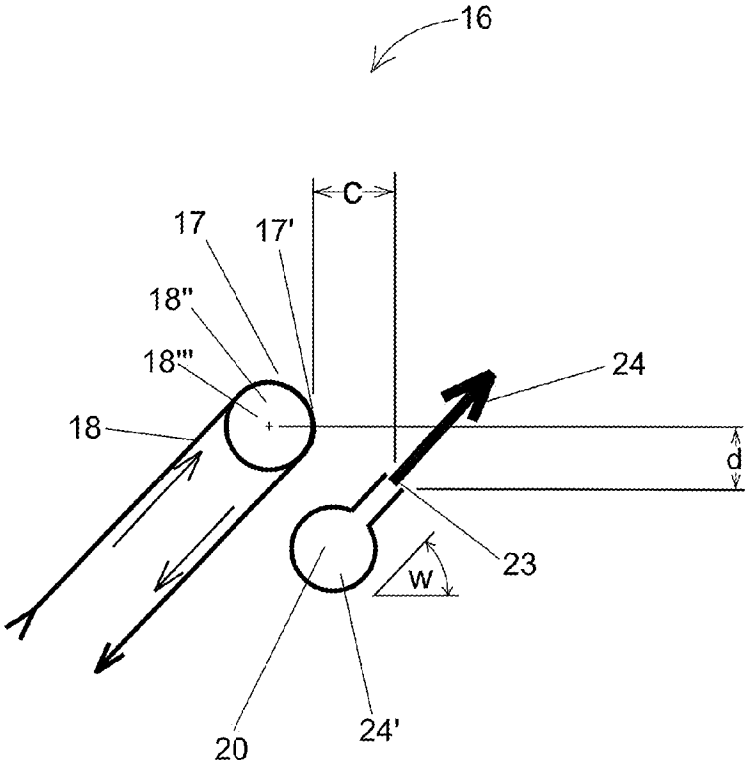

FIG. 3A illustrates relative positions of the second or upper end 17 of the first conveyor belt 18 and the air manifold 20 and the sheet of air 24. The exit 23 of the air manifold 20 is a distance "c" in front of (forward of) the end of the roller 18" of the conveyor belt system 16, and a distance "d" below the center 18' of the roller 18". The distance "c" may be either positive or negative (if negative, then the exit 23 of the manifold 20 is recessed behind the top end 17 of the conveyor belt roller 18"), and the air exit 23 of the manifold may be flush (c=0) with the right most edge 17' of the conveyor belt 18.

Referring again to FIG. 1, a second conveyor belt system 30 is shown disposed downstream to the right of the first conveyor belt system 16. The second conveyor system 30 has a conveyor belt 32 and at least two rollers 32' and 32" which support the conveyor belt, with one of the two rollers 32' or 32" driving the conveyor belt. The second conveyor system 30 has an elevated fourth end 33 disposed so as to provide an angle of elevation "b" of the conveyor belt 32 between the lower roller 32' of the first end and the upper roller 32" of the second end. The angle "b" is variable and is suitably between approximately 30 degrees and 60 degrees from the horizontal, such as 45 degrees. The rollers 32' and 32" are horizontally disposed. The bottom most portion 37 of the roller 32' is situated some positive distance or altitude H2 above floor F. The altitude H2 of the roller 32' can be the same as the altitude H1 of roller 18', or it can be greater or less than H1. Though not shown in any illustration, the conveyor belt 32 of the second conveyor belt system 30, also has a length L and a width W that are completely homologous with those dimensions that are illustrated in FIGS. 2A and 2B for the first conveyor system 16.

The second conveyor belt system 30 has a second air knife system 24' including an air manifold 34 and a planar air ejection orifice 35 so as to produce a planar sheet of an air knife 36 (arrow). The planar air knife 36 may be inclined at an angle "y" with respect to horizontal which may be the same as, greater than or less than the angle "b" of the conveyor system 30. The angle "y" could even be 0 degrees, i.e., aimed in a horizontal direction. The manifold 34 and air knife 36 of the second conveyor system 30 are disposed in relation to the conveyor belt 32 and rollers 32',32" as shown schematically in FIG. 3B, which is similar to the arrangement shown in FIG. 3A for the first conveyor belt system 16. That is, FIG. 3B shows the upper fourth end 33 of the second conveyor belt 32 and the air manifold 34 and the airstream 36, with the nozzle 35 of the air manifold 34 being at a distance "e" in front of (forward of) the end of the roller 32" of the second conveyor system 30, and a distance "f" below the center of the roller 32". The distance "e" may be either positive or negative (if negative, then the air exit 38 of the elongated nozzle 35 of the manifold 34 is recessed behind the right most fourth end 33 of the conveyor belt roller 32"), and the air exit 38 of the manifold may be flush (e=0) with the right most edge 33' of the conveyor belt 32.

The conveyor belt system 30 also has associated with it an air adhesion jet 31 being emitted from an elongated nozzle 41 that is attached to an air manifold 29. The adhesion air jet 31, and the associated air manifold 29 and nozzle 41, are all elongated in a direction that runs across the conveyor belt 32 and, as viewed in FIG. 1, into the page, i.e., perpendicular to the plane of the page. The adhesion air jet 31 serves the function of minimizing or eliminating the lift-off or flutter of the light fraction of lightweight solid waste pieces 14 from the conveyor belt 32.

It is envisioned that the second conveyor belt 32 might include one or more design features, such as variable surface texture, material construction, roughness and coefficient of friction variation, plus a steep angle "b" and even a vibrational feature, such as an eccentric roller 47 as described further below, so as to encourage to backward tumbling of such denser pieces 14 having any degree of sphericity. It is further envisioned in reference to the second conveyor belt system 30 that the angle "b" can be adjusted so as to encourage the backward tumbling of higher density pieces of solid waste 14 back to the third end 39 so as to fall into a second bin or collection area 51 while most of the remaining pieces of solid waste continue to the fourth end 33 and cascade over the second end and fall to the third collection area 60. The second and third collection areas 51 and 60 can be constructed of two spaced walls of the same of different heights to control the amount of the selected waste product to collect.

A portion of the solid waste pieces 14 that move on the second conveyor belt 32 of the second conveyor belt system 30, because of their shape and/or density, will roll or otherwise move in a direction that is counter to that of the conveyor belt 32, the result being that a certain separated fraction called a rollable mid fraction, will fall off of the lower or third end 39 of the second conveyor belt and thence fall into a second collection area or bin 51 while most of the remaining pieces of solid waste continue to the fourth end 33 and cascade over the second end and fall to the third collection area 60.

Referring again to FIG. 1, there is shown a third conveyor belt system 40 that is disposed downstream and to the right of the second conveyor belt system 30. The third conveyor system 40 has at least two rollers 42' and 42" which support the conveyor belt 42. At least one of the two rollers 42' or 42" drives the conveyor belt 42. The third conveyor system 40 has an elevated sixth end 43 disposed so as to provide an angle of elevation "c" of the conveyor belt 42 between the lower roller 42' of the fifth end 45 and the upper roller 42" of the sixth end. The angle "c" is variable and while being suitably between approximately 30 degrees and 60 degrees from the horizontal, such as 45 degrees, can be any desirable angle. The rotational axes of the rollers 42' and 42" are horizontally disposed with respect to the floor F. The fifth end and bottom most portion 45 of the roller 42' is situated some positive distance or altitude H3 above floor F. The altitude H3 of the roller 42' can be the same as the corresponding altitudes H1, H2 of roller 18' of the first conveyor system 16 and roller 32' of the second conveyor belt system 30, or it can be greater or less than H1 or H2.

The third conveyor belt system 40 also includes a third air knife system 24' including an air manifold 56 and a planar air ejection orifice 57 so as to produce a planar sheet of air so as to comprise an air knife 59 (arrow) emitted through linear orifice 58. The planar air knife 59 may be inclined at an angle "z" with respect to horizontal which may be the same as, greater than or less than the angle "c" of the conveyor system 40. The angle "z" could even be 0 degrees, i.e., aimed in a horizontal direction. The third conveyor belt system 40 also has associated with it an air adhesion jet 46 being emitted from an elongated nozzle 48 that is attached to an air manifold 49. The adhesion air jet 46, and the associated air manifold 49 and nozzle 48, are all elongated in a direction that runs across the conveyor belt 42 and, as viewed the perspective of FIG. 1, into the page, i.e., perpendicular to the plane of the page. The adhesion air jet 46 serves the function of minimizing or eliminating the lift-off or flutter of the light fraction of lightweight solid waste pieces 14 from the conveyor belt 42. This adhesion air jet 46 blows down upon, the third conveyor belt 42 so as to, in effect, pin the lightest pieces of solid waste 14 to the conveyor so as to force them to be carried to the top, i.e., so as to inhibit any tendency of the light-weight pieces of solid waste to become airborne and drift backward due to differential motion of the conveyor belt and the near stationary air immediately above it.

Description of Operation

During operation of the solid waste separation embodiment 10 shown in FIG. 1, pieces of solid waste 14 including heavy fraction, mid fraction and light fraction material are brought by some method, such as the conveyor belt system 12 illustrated, to a region near the first end 19 of the roller 18' of the first conveyor belt system 16. The pieces of solid waste 14 are then carried upward on the conveyor belt 18 to the second end 17 of the roller 18", i.e., to an elevation, from which they can cascade, i.e., fall, over the upper roller 18" toward a collection area or bin 50 on or near the floor F. To some extent, the upward motion of the conveyor belt 16 also contributes a "throwing" effect of the pieces of solid waste 14, such that the cascade might have a forward motion component, i.e., downstream to the right in FIG. 1. The collection area 50 can be constructed of two spaced walls of the same of different heights to control the amount of the selected waste product to collect.

Immediately after the solid waste pieces 14 commence their downward cascade, the heavy fraction including denser pieces pass through the planar sheet of air 24 that is the air knife, which causes the mid fraction and light fraction material of solid waste to move farther to the right as if upon an air bridge that is the jet of air from the air knife 24, i.e., toward the second conveyor belt 32 of the second conveyor belt system 30. Thus the heaviest or densest pieces of the heavy fraction of solid waste 14 fall into the first collection bin or area 50, while the lighter or less dense pieces of mid fraction and light fraction material, having been carried upon the air bridge 24, fall toward and onto the second conveyor belt system 30.

The second conveyor belt system 30, having received the mid fraction and light fraction material of the solid waste 14 near the third end 39, conveys most of it upward once again to an elevation from which they cascade, i.e., fall, over the upper roller 32" toward a third collection area or bin 60 on or near the floor F. The third collection area 60 can be constructed of two spaced walls of the same of different heights to control the amount of the selected waste product to collect.

Some of the pieces of solid waste 14 that commence the journey on the second conveyor belt 32, called rollable mid fraction material because of their shape and sometimes with the assist of the irregular surface and/or material of the conveyor belt 32 and/or the vibration feature, fall or roll backwards into the second collection area or bin 51. To some extent, the upward motion of the conveyor belt 32 contributes a "throwing" effect of the pieces of shredded solid waste 14, such that the cascade might have a forward motion component away from the top 33 or fourth end of the second conveyor belt 32. The speed of the conveyor belt 32 is sufficient to cause some of the least dense solid waste pieces 14 to flutter into the air and off of the conveyor belt, and it is because of this that the adhesion air jet 31 is in place, blowing downward onto the conveyor belt and thus pinning the lightweight pieces of solid waste to the conveyor belt 32 so that they traverse to and cascade over the higher end 33.

Immediately after the mid fraction and light fraction solid waste material 14 commence their second downward cascade from the second conveyor belt system 30, they pass through the planar sheet of air 36 that is the air knife, which conveys, as though over an air bridge, the light fraction solid waste farther downstream to the right, i.e., toward the third conveyor belt 42 of the third conveyor belt system 40. Once again, the heavier or denser pieces of the mid fraction solid waste 14 fall into the collection bin or area 60, while the lighter or less dense pieces of the light fraction material, having been carried on the air bridge 36, fall on the third conveyor belt system 40 so as to continue upward toward another elevation.

The specific function of the third conveyor belt system 40 in providing yet further separation of pieces of solid waste 14, according to weight or density, is described hereinbelow.

Whereas the conveyor belts 18,32,42 of the three conveyor belt systems 16,30,40 can be all of the same design, including width, length, thickness and surface texture, it is envisioned that each might also be different from the others in many respects, including length, width, thickness and surface properties such as texture. For example, it is envisioned that each of the conveyor belts 32 and 42 might have a surface structure, texture, material or design that includes lumps, dimples, or ribs, pencil-eraser-like protrusions (possibly made out of rubber), or even indentations or holes, so as to provide, in effect, a controllable coefficient of friction between the surface of the conveyor belts 32 and 42 and the solid waste pieces 14 being moved. The textured surface can allow certain of the solid waste to tumble backwards so as to fall off the third end 39 and fifth end 44 of the belt systems 30 and 40, respectively. Limp objects such as paper and film plastic are able to conform to an irregular or uneven surface, especially when acted upon by the influence of the adhesion air blowers 29 and 49. Certain pieces of the mid fraction material called rollable mid fraction material and pieces of the light fraction material called rollable light fraction material cannot conform to an irregular surface of the conveyor belts 32 and 42 respectively, and therefore have a tendency to roll or slide or otherwise fall backwards.

As with the second conveyor belt system 30, the third conveyor belt system 40 includes an adhesion air jet 46 so as to preclude the fluttering off of the conveyor belt 42 of the lightest weight, least dense, pieces of solid waste.

A portion of the solid waste pieces 14 that move on the third conveyor belt 42 of the third conveyor belt system 40, because of their shape and/or density, will roll or otherwise move in a direction that is counter to that of the conveyor belt 42, the result being that a certain separated fraction called a rollable light fraction, will fall off of the lower end 45 of the second conveyor belt and thence fall into a fourth collection area or bin 61. The fourth collection area 61 can be constructed of two spaced walls of the same of different heights to control the amount of the selected waste product to collect.

Both the conveyor belt 42 of the third conveyor belt system 40 and the conveyor belt 32 of the second conveyor system 30 might also have included in its design a vibrator or "thumper" feature 47 and 52, respectively. as to provoke denser pieces 14, especially ones having an aspect of sphericity, to tumble backwards and thus into the second collection area 51 which is to receive denser shredded solid waste pieces than might otherwise be carried to the top of the third conveyor belt system and thus into the fifth bin or collection area 70, which is where the lightest, least dense pieces of solid waste are intended to go. The fifth collection area 70 can be constructed of two spaced walls of the same of different heights to control the amount of the selected waste product to collect. A useful analogy may be to visualize the dense pieces of solid waste 14 as being like rocks, destined to settle in the earlier collection areas or bins 50,60, and the lighter pieces as feathers that are to end up in a fifth or final bin or collection area 70.

One possible vibrator or "thumper" arrangement might take the form of an eccentric roller 47,52, as shown in FIG. 1, having an off-center axis of rotation 54 (extending into the plane of the drawing). In this example of a vibrator system, the operation of which is intended to encourage the backward tumbling of denser pieces of solid waste 14 into the collection areas 51 and 61, the rollers 47 and 52 rotate about their off-center axis 54, thus, periodically, bumping or "thumping" the conveyor belts 32 and 42, respectively, upward in a regular periodic way, the vibrational frequency of which would be determined by the speed of rotation of the eccentric roller. It is envisioned that the eccentric rollers 47 and 52, which would extend across the width of the belts 32 and 42, respectively, might rotate in the same direction as the movement of the belts 32 and 42, or counter to that, and it might rotate at high speed or low speed, as seems to work best for the intended purpose of this embodiment 10.

Many other ways to introduce bumping, thumping or vibration can be imagined. For example, the axis of rotation 42''' of the upper roller 42'' could itself be eccentrically located, or the axis could itself be oscillated in a direction indicated, for example, by the arrows 55.

Variable Considerations in the Embodiment

In use, the conveyor belts 18,32,42 move at speeds that can be controlled and that are not necessarily equal to one another. The basic principle of this method of solid waste separation is that each conveyor belt 18,32,42 can move fast enough that each one effectively "throws" the pieces of trash 14 off the end. For instance, the first conveyor belt 18 would in effect "pitch" pieces of shredded solid waste 14 into an arc toward the second conveyor belt 32, with the effect of the first air knife 24 being such as to push lighter pieces of shredded waste yet farther from the first conveyor belt and more toward the second conveyor belt 32. Similarly for the speed of the second conveyor belt 32 in "throwing" the pieces of shredded solid waste 14 toward the third conveyor belt 42, with the second air knife 36 amplifying the separation process so that the lighter, less dense, pieces of shredded solid waste move farther from the top end 33 of the second conveyor belt. Speed adjustment is also used to promote single burden depth on the conveyor belts which facilitates separation efficiency.

Each of the three conveyor belt systems 16,30,40 of the present embodiment 10 can be varied with respect to running speed of the respective conveyor belts 18,32,42 and the respective elevation angles "a," "b," and "c." Each of the three conveyor belt systems 16,30,40 of the present embodiment 10 can also be varied with respect to the respective altitudes H1, H2, H3 above the floor F, such that the altitudes may be equal to one another or different from each other. It is envisioned that each of the three conveyor belts 18,32,42 of the conveyor belt systems 16,30,40 can or will be sized in their widths W such that the successive widths of each conveyor belt are wider than the preceding one so as to accommodate lateral spreading of the waste stream during processing.

Referring to FIG. 1, there is shown an arbitrarily located horizontal zero reference R0, from which the locations of the respective conveyor belt systems 16,30,40 can be described for the purposes of this disclosure. Accordingly, the left-most portion 21 of the first conveyor belt system 16 is shown in FIG. 1 at reference location R1, which is a distance of D1 from the zero reference R0, while the left-most portion and third end 39 of the second conveyor belt system 30 is shown at reference location R2, which is a distance of D2 from R1, and the left-most portion 44 of the third conveyor belt system 40 is shown at reference location R3, which is a distance of D3 from R2. The point to be made here is that the horizontal locations of the three conveyor belt systems 16,30,40 are variable such that the distance D2, between systems 16 and 30, and D3, between systems 30 and 40, can be but are not necessarily equal to one another. E.g., the upper most point 17 of the first conveyor belt system 16 can overhang the conveyor belt 32 of the second conveyor belt system 30 such that the length L (FIG. 2A) of the first conveyor belt system times the cosine of the angle "a" can stand in relation to the distance D2 such that $D2 \leq L \cos(a)$ or $D2 \geq L \cos(a)$.

The surface texture and properties of the respective conveyor belts 18,32,42 are, as mentioned above in specific reference to the third conveyor belt 42, envisioned as being variable in relation to effective coefficient of friction with respect to the pieces of solid waste 14 being carried, with provision for such variable coefficient of friction being of the sort described above for the third conveyor belt.

Finally, it is envisioned that the partitioning of the heavy fraction, mid fraction and light fraction pieces of solid waste 14 that enter into the operating embodiment 10 can be controlled by a control system 62 communicating with each conveyor belt system 16,30,40 individually to adjust combinations of the following:

- speed of the respective conveyor belts 18,32,42;
- respective elevation angles "a," "b," and "c" of the conveyor belts 18,32,42;
- angles "w," "y," and "z," and the flow rates of the respective air knives 24,36;
- "offset" distances "c," "d," "e," "f," of the air knives 24,36 with respect to the high points 17,33 of the first and second conveyor belts 18,32;
- altitudes H1, H2, H3 of each conveyor belt system 16,30, 40;
- distances D2, D3 between conveyor belt systems 16 and 30, and conveyor belt systems 30 and 40;
- different surface textures of the respective conveyor belts 18,32,42 so as to control the selection of the pieces of solid waste that can tumble backwards to fall off of the second and third and fifth ends of the conveyor belts 32 and 42 and to drop into the preceding collection areas 51 and 61, respectively;

the speed, and thus frequency, of the exemplary vibrational thumping provisions 47 and 54; amount of adhesion air 46, 31; and the heights of the bins 50,51,60,61 and 70.

Everyone of the aforementioned adjustments is necessary to effortlessly "tune" the system for accurate, optimal sorting performance.

The embodiment has been illustrated and described in a manner that should be considered as exemplary rather than restrictive in character it being understood that only preferred embodiments have been shown and described, and that all changes and modifications that come within the spirit of the embodiment are desired to be protected. Undoubtedly, many other "variations" on the techniques set forth hereinabove will occur to one having ordinary skill in the art to which the present embodiment most nearly pertains, and such variations are intended to be within the scope of the embodiment, as disclosed herein.

What is claimed is:

1. A sorting system for separating solid waste including heavy fraction, mid fraction and light fraction materials of paper and light plastic film, comprising:

a first conveyor belt system for moving the solid waste from a first end to a second end so that the solid waste cascades over the second end whereby the heavy fraction material falls downward to a first collection area;

a first air manifold situated beneath the second end of the first conveyor belt system forming a first planar sheet of air to convey the mid fraction and light fraction materials of the solid waste to a second conveyor belt system;

the second conveyor belt system for moving the mid fraction and light fraction material received from the first conveyor belt system from a third end to a fourth end of the second conveyor belt system;

the fourth end of the second conveyor belt system being elevated above the third end the second conveyor belt system whereby a rollable mid fraction of the solid waste can tumble backwards to the third end of the second conveyor belt system and drop into a second collection area while the remaining mid fraction and light fraction solid waste continues to the fourth end and cascades over the fourth end whereby the mid fraction pieces of solid waste fall downward into a third collection area; and a second air manifold situated beneath the fourth end of the second conveyor belt system forming a second planar sheet of air to convey light fraction materials of the solid waste to a third conveyor belt system.

2. The sorting system of claim 1 wherein:

the third conveyor belt system is disposed for moving the pieces of light fraction solid waste received from the second conveyor belt system from a fifth end to a sixth end of the third conveyor belt system;

the third conveyor belt system is disposed at an angle of elevation so that a rollable light fraction solid waste that can tumble backwards to the fifth end of the third conveyor belt system and drop into a fourth collection area while the remaining pieces of light fraction solid waste continue to the sixth end and cascade over the sixth end; and a third air manifold situated beneath the sixth end of the third conveyor belt system forming a third planar sheet of air to carry away light fraction pieces of solid waste to a fifth collection area; and wherein the light fraction pieces of solid waste are lightweight film plastic.

3. The sorting system of claim 2 further including first and second air manifolds each having a nozzle for directing air adhesion jets at the second and third conveyor belt systems for reducing lift-off of the light fraction of lightweight solid waste pieces from second and third conveyor belt systems.

4. The sorting system of claim 3 further including a system for adjusting the speed of the first, second, and third conveyor belt systems.

5. The sorting system of claim 4 further including a system for adjusting the elevations of the first, second, third, fourth, fifth and sixth ends, respectively, of the first and second and third conveyor belt systems.

6. The sorting system of claim 3 further including second and third conveyor belts for the second and third conveyor belt systems, respectively, of different surface textures to control the selection of the solid waste that can tumble backwards to drop off of the third and fifth ends of the second and third conveyor belt systems into the second and fourth collection areas, respectively.

7. The sorting system of claim 1 further including a delivery system to deliver solid waste onto the first conveyor belt system.

8. The sorting system of claim 2 further including first, second and third air knife systems disposed at the second, fourth and sixth ends of the first, second and third conveyor belt systems to provide the planar sheets of air.

9. The sorting system of claim 2 wherein the third conveyor belt system has a third conveyor belt and includes a vibrator for vibrating the third conveyor belt.

10. The sorting system of claim 2 wherein the second conveyor belt system has a second conveyor belt and includes a vibrator for vibrating the second conveyor belt.

11. A method for separating solid waste including heavy fraction, mid fraction and light fraction materials of paper and light plastic film, comprising:

moving the solid waste from a first end to a second end of a first conveyor belt system;

conveying the mid fraction and light fraction materials of the solid waste first conveyor belt system to a second conveyor belt system with a first planar sheet of air so that the heavy fraction material falls to a first collection area and the mid fraction and light fraction material are conveyed to a second conveyor belt system;

moving the mid fraction and light fraction material received from the first conveyor belt system from a third end to a fourth end of the second conveyor belt system whereby a rollable mid fraction of the solid waste can tumble backwards to drop into a second collection area while the remaining mid fraction and light fraction solid waste cascades over the fourth end of the second conveyor belt system whereby the mid fraction pieces of solid waste fall downward to a third collection area and light fraction solid waste is conveyed to a third conveyor belt system with a second planar sheet of air to be is collected in a fifth collection area.

12. The method of claim 11 further including moving the pieces of light fraction solid waste received from the second conveyor belt system from a fifth end to a sixth end of a third conveyor belt system whereby rollable light fraction solid waste that can tumble backwards and drop into a fourth collection area while the remaining pieces of light fraction solid waste continue to the sixth end and cascade over whereby light fraction pieces of solid waste is collected in a fifth collection area.

13. The method of claim 12 including disposing the second end, the fourth end and the sixth end of first, second and third conveyor systems, respectively, at a higher elevation than the first, third and fifth ends, respectively.

14. The method of claim 13 further including adjusting the speed of the first, second, and third conveyor belt systems.

15. The method of claim 13 further including adjusting the elevations of the first, second, third, fourth, fifth and sixth ends of the first and second and third conveyor belt systems, respectively.

16. The method of claim 13 further including controlling the selection of the solid waste that can tumble backwards to drop off of the third and fifth ends of the second and third conveyor belt systems into the second and fourth collection areas, respectively.

17. The method of claim 11 further including delivering solid waste onto the first conveyor belt system.

18. The method of claim 12 further including providing planar sheets of air at the second, fourth and sixth ends of the first, second and third conveyor belt systems.

19. The method of claim 12 including vibrating a conveyor belt of the third conveyor belt system.

20. The method of claim 12 including vibrating a conveyor belt of the second conveyor belt system.

21. The sorting system of claim 6 wherein the second and third conveyor belts are of different material compounds to control the selection of the solid waste that can tumble backwards to drop off of the third and fifth ends of the second and third conveyor belts, respectively, into the second and fourth collection areas, respectively.

* * * * *